United States Patent [19]

Fuchs

[11] Patent Number: 4,660,330

[45] Date of Patent: Apr. 28, 1987

[54] BEVEL TOOL

[75] Inventor: Otto Fuchs, Westlake Village, Calif.

[73] Assignee: Burroughs Corporation, Detroit, Mich.

[21] Appl. No.: 299,098

[22] Filed: Sep. 3, 1981

[51] Int. Cl.[4] ..... B24B 9/00

[52] U.S. Cl. ..... 51/216 R; 51/217 P; 51/229; 51/221 R; 269/237; 269/254 R

[58] Field of Search ..... 51/216 R, 217, 229, 51/220, 221 R, 221 BS; 279/1 SG, 1 K, 23, 41; 269/254 R, 254 CS, 157, 237, 907

[56] References Cited

U.S. PATENT DOCUMENTS

| | | | |
|---|---|---|---|
| 1,900,922 | 3/1933 | Evans | 279/23 A |
| 2,437,495 | 3/1948 | Anderson | 51/221 R |
| 2,479,796 | 8/1949 | Warzynski | 279/41 |
| 2,737,657 | 3/1956 | Miller | 269/254 CS |
| 4,375,284 | 3/1983 | Doiron | 269/237 |

FOREIGN PATENT DOCUMENTS

| | | | |
|---|---|---|---|
| 361917 | 10/1922 | Fed. Rep. of Germany | 279/1 K |
| 1120246 | 12/1961 | Fed. Rep. of Germany | 279/1 SG |
| 70790 | 7/1946 | Norway | 51/221 BS |

*Primary Examiner*—Frederick R. Schmidt
*Assistant Examiner*—Debra S. Meislin
*Attorney, Agent, or Firm*—John J. McCormack; Nathan Cass; Kevin R. Peterson

[57] ABSTRACT

Described is a novel "bevel tool" and associated technique for holding prescribed magnetic head workpieces and placing them in prescribed constant angular relation with a rotary lapping means; this tool preferably including a workpiece-receiving pocket adapted to be spread apart and to resiliently grip the work, with one or more guide-faces surrounding this pocket and adapted to indicate a prescribed orientation of the work against a prescribed "lapping plane".

9 Claims, 6 Drawing Figures

BEVEL TOOL

BACKGROUND, FEATURES OF INVENTION

This invention relates to magnetic recording heads and more particularly to a technique and associated tool for gripping a head workpiece and engaging it in prescribed angular relation with a lapping means to "blend" (bevel) prescribed edges of the workpiece.

Workers in the art of making and using magnetic recording heads for high performance digital data recording (e.g., with floppy disks) are aware that in the course of manufacturing such heads, certain edges or corners thereof are typically beveled or "blended" (rounded) in a prescribed known fashion. This invention relates to a technique and an associated tool enabling one to prescisely control such a blending operation and to perform the operation faster, more repeatably and with minimal scrap. It will be seen that other advantages such as nominal tooling costs and very little operator training required will also result.

BRIEF DESCRIPTION OF THE DRAWINGS

The foregoing and other features and advantages of the present invention will be appreciated by workers as they become better understood through reference to the following detailed description of preferred embodiments which should be considered in conjunction with the accompanying drawings, wherein like reference symbols denote like elements.

FIG. 2 represents the embodiment in "open" condition; with the opening tool shown in FIG. 2A, while

DESCRIPTION OF THE PREFERRED EMBODIMENTS

The following description of methods and associated fixtures is given by way of example to indicate preferred embodiment according to the invention. Except as otherwise specified, workers should assume that conventional related methods, conditions, materials, etc., obtain throughout, conforming to present good practice in the art.

Figure 5:
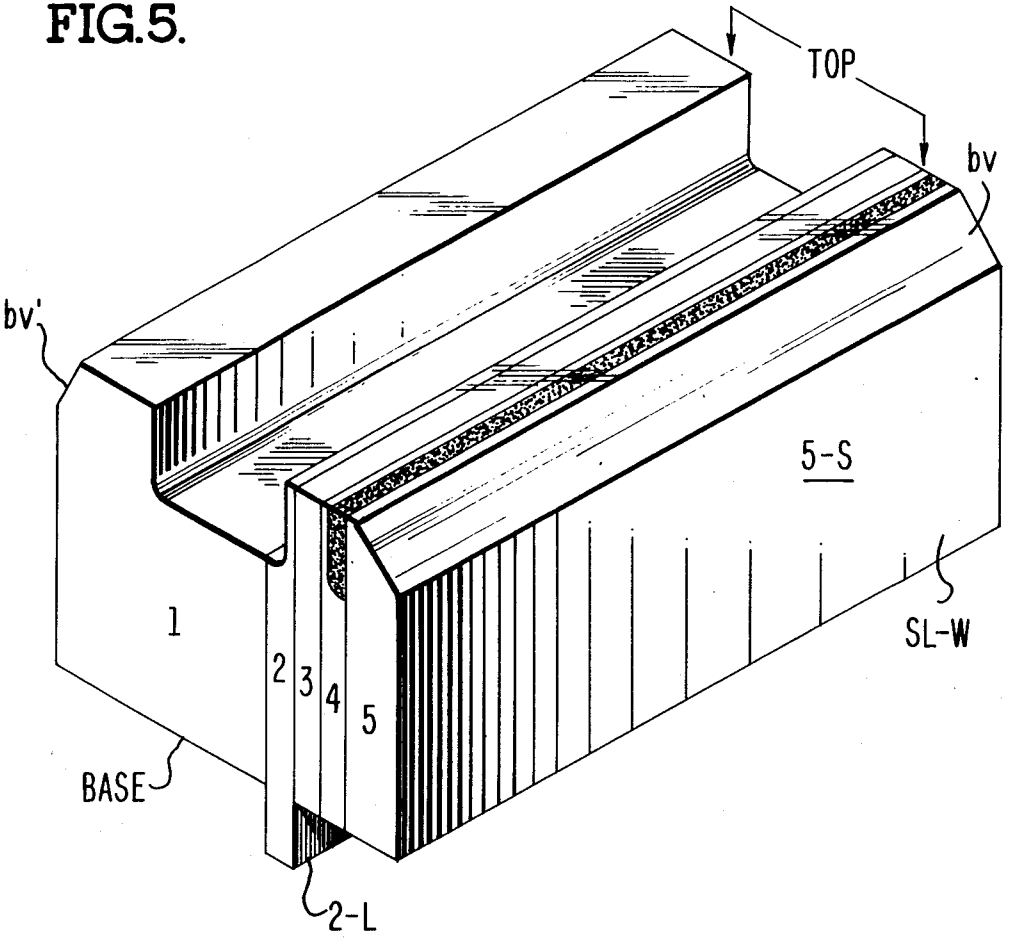
FIG. 5 is an idealized perspective showing of an exemplary "slider" workpiece for such a tool.

Workers in the art of making and using magnetic recording heads for digital data recording (e.g., with high performance floppy disks) are aware of the various operations typically undertaken in manufacturing the recording "slider" and more particularly are aware that various portions of the slider workpiece must at various times be beveled or blended. Slider workpiece SL in FIG. 5 is an example of this, wherein two corners are indicated as having been beveled ("blended"—or rounded) at bv, bv'. This invention is directed toward providing a means for better holding such a slider and also engaging it against a (resilient) lapping means, such as pad L-p of lapping wheel L-W shown schematically in FIG. 4.

Figure 4:
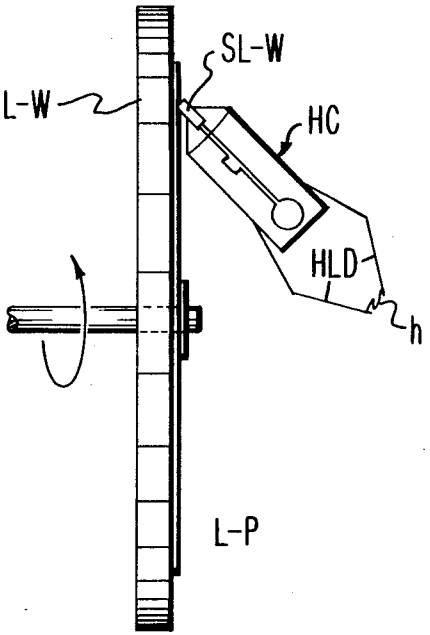
FIG. 4 is a schematic representation of this embodiment gripping a workpiece in prescribed relation with a lapping wheel for one prescribed blending operation.

In FIG. 4 wheel L-W may comprise any known rotatable lapping means and preferably is adapted to receive a removable lap-pad L-p. As workers know, such pads include a resilient elastomeric backing and an abrasive contact-face of prescribed lapping ability. Here, it will be understood that a slider workpiece shown as SL has been engaged firmly by a holder or blending tool HC according to my invention, with tool HC being held at a prescribed orientation against peel-away pad L-p (pressing-into it a prescribed amount) to effect the corner-blending. In this fashion it will be understood that the workpiece SL (prescribed corners thereof) is to be presented in prescribed angular relation with pad L-p so that the blending and lapping operation may produce a beveled surface with the same constant configuration and orientation each time the operation is performed.

For this reason and according to one feature of the subject blending tool HC it will be seen that the tool is designed to present guide faces lg adapted to assist the operator in maintaining this angular relation between the slider and the lapping wheel.

Figure 3:
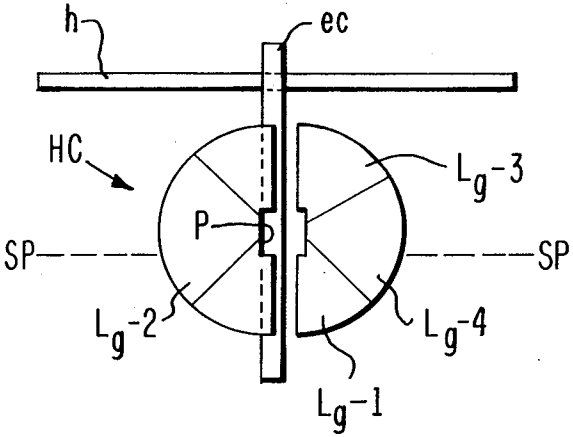
FIG. 3 is a plan view of the showing in FIG. 1.
Figure 1:
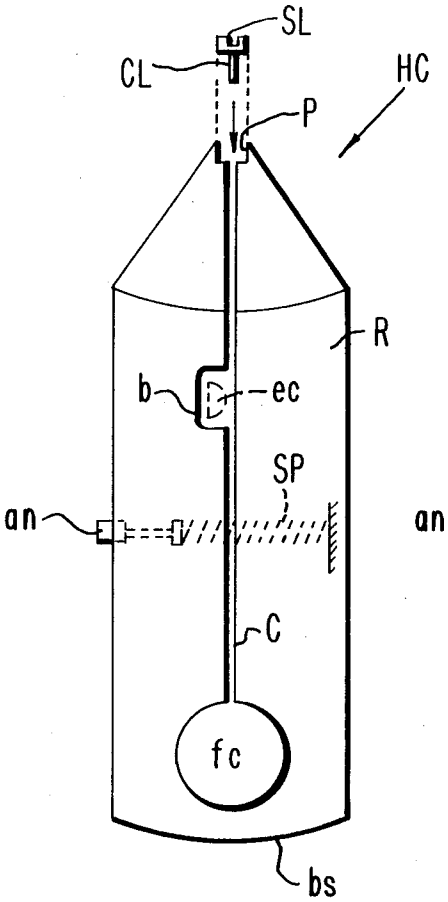
FIG. 1 is a schematic elevation of a blending tool embodiment shown in "closed" condition.

Turning to FIGS. 1 and 3 the blending tool embodiment HC is shown in elevation and plan view respectively and will be seen to essentially comprise a relatively rigid cylindrical rod R having an internal flexure cavity fc adjacent one end (adjacent base bs) and being formed with a longitudinal gap or slit g communicating between this cavity fc and the opposite end of the rod. Both the gap g and the communicating cavity fc will be seen to extend across the entire cross section of rod R. Tool HC is shown in its "closed" condition in FIG. 1 and will be understood as intended to accommodate a certain parting means to be inserted to open gap g and spread apart the two sides of the rod R to enlarge the gap enough to insert a prescribed slider SL into an associated receiving pocket P dimensioned to be slightly narrower than slider SL, along spread-direction SP—SP, see FIG. 3. Also, another feature is that this pocket is located so that the typical core legs, e.g., leg 2-L in FIG. 5, are received in the communication section of gap g.

Figure 2A:
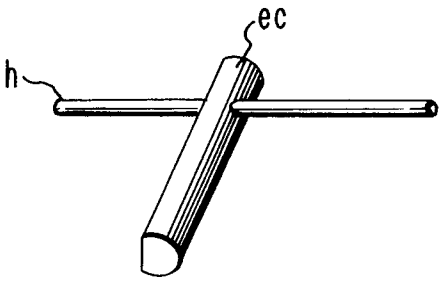

For this reason the metal used in rod R and the dimensions of gap g and cavity fc will be understood as adapted to provide sufficient flexibility so the prescribed parting means (e.g., in FIG. 2A) can readily throw the rod "open" sufficient to insert the slider, and yet retain sufficient return resilience for return spring (e.g., by spring SP) and firmly engage and retain the slider during lapping (e.g., while performing the blending operations indicated above relative to FIG. 4).

Figure 2:
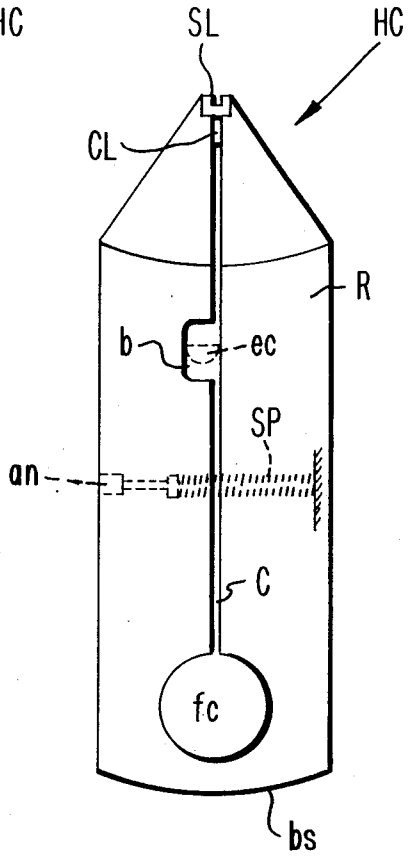

Thus, as here indicated in FIGS. 1 and 2 and according to an improvement feature, such a parting means is provided in the form of a rotatable eccentric cam-axle ec adapted to be inserted in an accommodating "rectangular" bore through rod R, intermediate the length of gap g at some suitable point. Axle ec will be rotatable manually, by an attached handle h as known in the art and shown particularly in FIG. 3. Axle ec can be conveniently formed, preferably by simply cutting away a standard cylinder enough to impart the desired spread-dimension (e.g., here, 10–15 mils cut, leaving the illustrated "flat" along axle ec). The receiving bore b through rod R is dimensioned as indicated in FIG. 1 to be rectangular and conform rather snugly to this dimension when axle ec is injected in its upright or closed orientation as FIG. 1. Axle ec is so dimensioned and its receiving bore is so configured (e.g., having a relatively flat side as indicated more clearly in FIG. 2) that when it is rotated 90° its rounded sides will thrust spreadingly against the base of this bore on one hand and the opposite side of the gap g on the other, and so spread rod R to its "open" condition as indicated in FIG. 2 for receipt of the workpiece as mentioned. Once the workpiece (e.g., slider SI) is seated in pocket P at the end of gap g, sufficient of the workpiece body is exposed to guide the blending or other operations as indicated in FIG. 4. Axle ec may then be rotated 90° to return rod R to its "closed" condition as in FIG. 1 (under action of return spring SP) and firmly grip the workpiece for subsequent operations as desired. Return spring SP is of conventional construction and is preferably made adjustable in tension via adjust-nut "an", as known in the art. Rod R may comprise aluminum stock or like semi rigid material.

Workers in the art will thus realize that the material and dimensions of rod R and its associated gap g and flexure cavity fc will be formed to impart sufficient flexibility thereto that the parting tool may be readily operated to open the "jaws" of holder HC—while at the same time the rod will accommodate the return-spring action so that with the work inserted and the tool closed the so-formed jaws will retain this workpiece with sufficient strength to perform the contemplated lapping.

As suggested above, the head of tool HC may also be provided with a number of registration surfaces or guide faces lg such as the four angular faces lg-1 through lg-4 seen in FIG. 3. As indicated functionally in FIG. 4 each one of these faces (they may be numbered or otherwise identified) may be configured to indicate a prescribed respective angular relation with a lapping wheel (e.g., on guide-face lg for each desired blending site bv). Thus a slider may be registered in a prescribed constant orientation with the lapping means. Workers in the art will appreciate how convenient this is and yet how accurately it may operate to guide an operator in performing certain beveling operations in the same uniform way, quickly and easily.

Workers in the art will see many advantages associated with such a tool and the associated blending techniques. They will see how this technique allows one to precisely control the blending operation and allow an operator to perform the operation rapidly and with minimal scrap. It will be evident that the tool costs very little and that it requires very little operator training for its proper use. For example, I have found that such a tool may be made for well under one hundred dollars and used effectively by relatively unskilled labor—whereas formerly workers in the art were forced to provide special grinding equipment costing many thousands of dollars and requiring the use of skilled, expensive operators.

Workers will also appreciate that this concept may be modified to achieve other like results. For instance, an automatic apparatus may be built comprising a rotatable turret mounting one or several of such "blending holders" and adapted to automatically index to a prescribed guide face lg (oriented relative to plane of pad L-p) and present it in constant lapping relation with the lap pad L-p. And, while one such tool holder is being so manipulated for lapping, another like holder may be serviced by an operator removing a "so-lapped" slider and replacing it with a new slider-to-be-lapped.

It will be understood that the preferred embodiments described herein are only exemplary, and that the invention is capable of many modifications and variations in construction, arrangement and use without departing from the spirit of the invention.

Further modifications of the invention are also possible. For example, the means and methods disclosed herein are also applicable to other like sliders and the like. Also, the present invention is also applicable for providing holder means for other tiny workpieces.

The above examples of possible variations of the present invention are merely illustrative. Accordingly, the present invention is to be considered as including all possible modifications and variations coming within the scope of the invention as defined by the appended claims.

What is claimed is:

1. An improved lapping tool and holder device for receiving and firmly gripping a prescribed workpiece and then accommodating its presentation in prescribed constant relation with a certain lapping plane, the device comprising:

elongate rod means including a flexure cavity internally of its length and a workpiece-receiving pocket at a prescribed working-end, the rod means being slit between said cavity and said pocket and adapted to be spread-apart along this slit sufficient to receive a said workpiece by insertion of prescribed parting means at said slit; the working-end including one or more guide-faces oriented to indicate a prescribed orientation of the device against said lapping plane.

2. The combination as recited in claim 1 wherein the lapping plane is defined by a resilient lap surface and at least one corner beveling operation is guided by an associated guide-face.

3. The combination as recited in claim 2 wherein the rod means includes a relatively rectangular cut-out intermediate along the slit and wherein the parting tool includes flattened cam-axle means adapted to be inserted in said cut-out and rotated to spread-apart said slit and open said pocket a prescribed pocket-increment sufficient to receive said workpiece.

4. The combination as recited in claim 3 wherein said rod means also includes return-spring means adapted to resiliently urge said slit "closed" to retain the workpiece in said pocket.

5. The combination as recited in claim 4 wherein the spring means is tension-adjustable.

6. The combination as recited in claim 5 wherein said pocket is dimensioned to receive and firmly hold a slider workpiece for corner-beveling thereof.

7. The combination as recited in claim 6 wherein the rod means comprises an aluminum cylinder.

8. The combination as recited in claim 3 wherein the parting means comprises a rotatable cam-axle having a flat cut-away along its length to remove a radial dimension approximating the desired pocket increment spread dimension.

9. The combination as recited in claim 8 wherein said rod means also includes return-spring means adapted to resiliently urge said slit "closed" to retain the workpiece in said pocket.

* * * * *